United States Patent [19]

Dörsam et al.

[11] Patent Number: 4,938,134

[45] Date of Patent: Jul. 3, 1990

[54] PRINTING PLATE CLAMPING ASSEMBLY

[75] Inventors: Willi R. L. Dörsam, Höchberg; Karl-Heinz A. Schneider, Würzburg, both of Fed. Rep. of Germany

[73] Assignee: Koenig & Bauer Aktiengesellschaft, Würzburg, Fed. Rep. of Germany

[21] Appl. No.: 243,724

[22] Filed: Sep. 13, 1988

[30] Foreign Application Priority Data

Sep. 16, 1987 [DE] Fed. Rep. of Germany ..... 3731039

[51] Int. Cl.[5] ..... B41F 27/12

[52] U.S. Cl. ..... 101/415.1; 101/378

[58] Field of Search ..... 101/415.1, 378, 383, 101/DIG. 12

[56] References Cited

U.S. PATENT DOCUMENTS

| | | | |
|---|---|---|---|
| 3,058,417 | 10/1962 | Norlin | 101/415.1 |
| 3,176,843 | 4/1965 | Hoskins et al. | 101/415.1 X |
| 3,715,981 | 2/1973 | Huffman | 101/415.1 |
| 4,157,067 | 6/1979 | Dätwyler | 101/415.1 |
| 4,596,188 | 6/1986 | Bonomi | 101/415.1 |
| 4,598,642 | 7/1986 | Saüer et al. | 101/415.1 |

FOREIGN PATENT DOCUMENTS

| | | |
|---|---|---|
| 0132864 | 2/1985 | European Pat. Off. . |
| 1172690 | 1/1965 | Fed. Rep. of Germany . |
| 6927286 | 7/1969 | Fed. Rep. of Germany . |
| 2626503 | 12/1977 | Fed. Rep. of Germany . |

*Primary Examiner*—Edgar S. Burr
*Assistant Examiner*—Moshe I. Cohen
*Attorney, Agent, or Firm*—Jones, Tullar & Cooper

[57] ABSTRACT

A flexible printing plate clamping assembly utilizes a printing plate clamping device disposed in a groove in a plate cylinder. A plurality of elbow lever assemblies are used to move a clamping bar between plate clamping and unclamping position. These elbow lever assemblies have pneumatic devices and counteracting springs to place them in either clamping or unclamping positions.

5 Claims, 2 Drawing Sheets

PRINTING PLATE CLAMPING ASSEMBLY

FIELD OF THE INVENTION

The present invention is directed generally to a printing plate clamping assembly. More particularly, the present invention is directed to a flexible printing plate clamping and tensioning assembly. Most specifically, the present invention is directed to a flexible printing plate clamping and tensioning assembly for a plate cylinder of a rotary printing press. A groove in the plate cylinder carries a printing plate clamping assembly which uses a pair of lever elements to open and close a clamping bar. The printing plate clamping assembly is slidable within the groove in the plate cylinder to tension the printing plate once it has been clamped by the clamping bar. Various pneumatic devices and springs are used to apply and release clamping and tensioning forces.

DESCRIPTION OF THE PRIOR ART

Printing plate clamping devices are generally known in the art and are useable to clamp or otherwise secure the ends of printing plates on the surface of a printing plate cylinder in a rotary printing machine. One such printing plate clamping device is disclosed in German Published, Non-examined Patent Application No. DE-OS 26 26 503. In this device, a printing plate edge is clamped between parallel clamping surfaces of a plate support fixed on a housing and a clamping bar extending vertically to the plate support. Movement of the clamping bar takes place through a plurality of axially disposed elbow lever mechanisms on which an eccentric acts in the are of the elbow levers. The eccentrics are disposed on a common shaft and are actuated together when the shaft is turned. Movement of the elbow lever mechanisms takes place past a stretch position into a stable top dead center position against a second eccentric which is in the form of a stop. To move the elbow levers from their stable top dead center position, the second eccentrics are pivoted by a second common shaft in opposition to the direction of action of the first eccentrics.

This above-discussed prior art printing plate clamping device must be operated by hand or with tools and this is apt to result in a prolongation of printing press set-up times. It is also not possible to adapt this plate clamping assembly for automatic operation. Thus a press operator must physically either manually, or with the aid of suitable tools operate this prior art device.

Various other printing plate clamps and holders are also generally known in the art. These are apt to be somewhat complex devices which, as with the above discussed device, require manual operation and are apt to entail substantive press down time. It will thus be apparent that a need exists for a flexible printing plate clamping and tensioning device which is operable without tool and at a remote location. The printing plate clamping assembly in accordance with the present invention provides such a device.

SUMMARY OF THE INVENTION

It is an object of the present invention to provide a printing plate clamping assembly.

A further object of the present invention is to provide a flexible printing plate clamping and tensioning assembly.

Another object of the present invention is to provide a flexible printing plate clamping and tensioning assembly for a printing cylinder of a rotary printing press.

Yet a further object of the present invention is to provide a flexible printing plate clamping assembly which requires no tools to operate.

Still another object of the present invention is to provide a flexible printing plate clamping assembly which may be operated remotely.

As will be discussed in detail in the description of the preferred embodiment which is set forth subsequently, the flexible printing plate clamping assembly in accordance with the present invention utilizes a printing plate clamping device which is positioned in an axially extending groove at the periphery of a printing plate cylinder. A plate clamping bar is pivotably carried in this device and is moved into and out of plate clamping positions by an elbow lever assembly. This elbow lever assembly is operated by a pneumatic means and is opposed by springs. When the elbow lever assembly is extended to a straight position by the springs, it clamps the flexible printing plate. When the pneumatic or hydraulic pressure is applied, the springs are compressed to let the elbow lever assembly fold to unclamp the printing plate.

The printing plate clamping device is also slidable in a circumferential direction in the axially extending groove in the plate cylinder. Once the flexible printing plate has been clamped, the plate clamping device may be slid in the circumferential direction in the groove to impart additional tension to the plate. This circumferential motion may be accomplished by using a second pneumatic device which works in opposition to a second spring.

The flexible printing plate clamping assembly in accordance with the present invention is superior to prior art devices for several reasons. No tools are require to set up the printing plate on the plate cylinder. This reduces set-up time and also means that no tool sockets or other points of tool engagement need be provided on the plate cylinder. Another advantage of the present device so that it may be controlled by the operator in a remote manner such as, for example, by foot pedal. This allows the operator to have his hands free for performing other tasks while setting up the machine.

The flexible printing plate clamping assembly for plate cylinders of a rotary printing machine in accordance with the present invention is less complex than prior devices, requires no tools and can be operated in a remote location. It reduces printing press set-up time and provides an apparatus which is a substantial improvement over the presently available devices.

BRIEF DESCRIPTION OF THE DRAWINGS

While the novel features of the printing plate clamping assembly in accordance with the present invention are set forth with particularity in the appended claims, a full and complete understanding of the invention may be had by referring to the detailed description of preferred embodiments which are set forth subsequently, and as illustrated in the accompanying drawings, in which:

DESCRIPTION OF THE PREFERRED EMBODIMENTS

Figure 1:
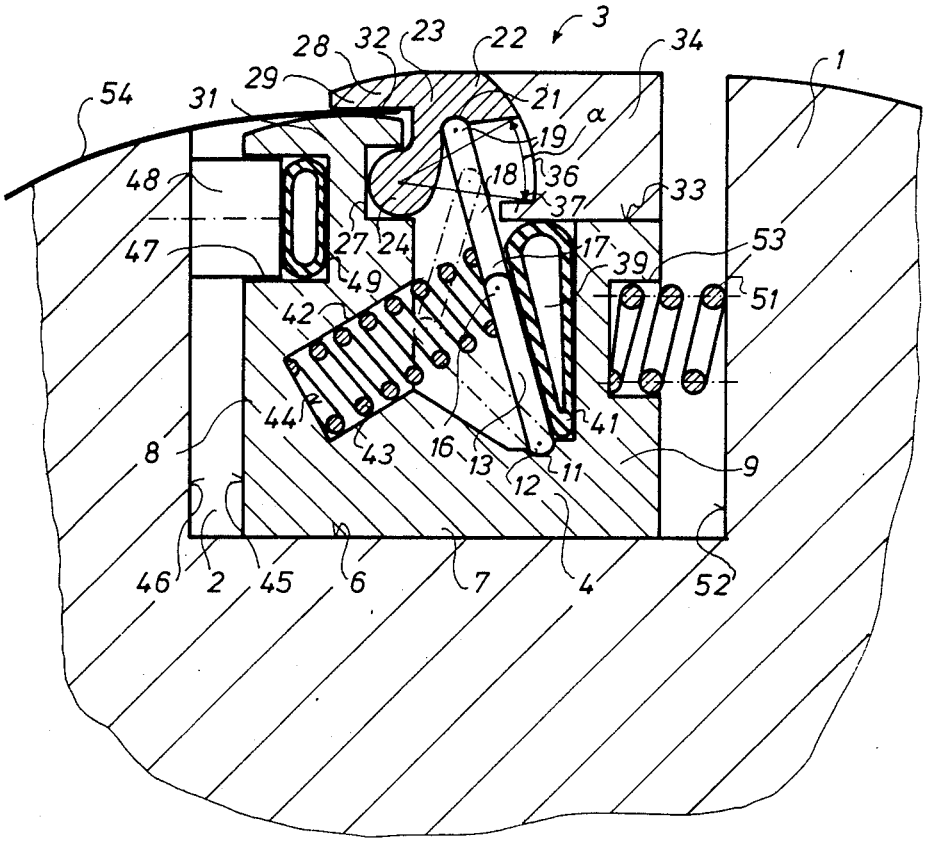
FIG. 1 is a cross-sectional view of a portion of a plate cylinder and showing a first preferred embodiment of the plate clamping assembly in accordance with the present invention.

Referring initially to FIG. 1 there is shown a portion of a printing plate cylinder, generally at 1 of a rotary printing assembly. Plate cylinder 1 is provided with a generally conventional axially extending groove 2 at its periphery. Axially extending groove 2 receives a first preferred embodiment of a printing plate clamping device, generally at 3, in accordance with the present invention. This printing plate clamping assembly 3 has a main housing 4 which extends the length of groove 2. This housing 4 is positioned on a bottom surface 6 of groove 2 and is slidable circumferentially in groove 2 both in, and opposite to, the direction of rotation of plate cylinder 1. This main housing 4 has a bottom portion 7, a left side wall 8 and a right side wall 9. The bottom part 7 has a plurality of bearing surfaces 11 which are parallel to groove bottom 6 and which are shaped for receiving the spaced lower ends 12 of each of a plurality of first, or lower connecting rods 13 of spaced elbow lever mechanisms. An upper end 16 of each of the first or lower connecting rods 13 is pivotably linked with a lower end 17 of a second, or upper connecting rod 18.

An upper end 19 of the upper rod 18 is supported in a bearing 21. This bearing 21 is formed below a right lever arm portion 22, rounded at its end, of a clamping bar 23. The clamping bar 23 is generally in the shape of the letter T and is supported by its somewhat rounded bottom part, which is in the form of a bearing 24, in a thrust bearing 27 in the left side wall 8. The thrust bearing 27 is formed as a rectangular groove in the side wall 8 with its opening facing in the direction of the center of the groove 2.

One end of a left lever arm portion 28 of the clamping bar 23 is structured as a clamping flap 29 and acts on an upper part of the side wall 8 which serves as a plate support 31. One printing plate edge 32 is clamped between the plate support 31 and the clamping flap 29. A guide rail 34 is attached to the upper edge 33 of the side wall 9. This guide rail 34 has a concave recess 36 facing towards the center of the groove and in which the rounded end of the right lever arm 22 is guided during pivoting of the clamping bar 23 and defines, with its lower side, in concert with the right sidewall 9, the connecting rods 13, 18 and part of the bottom plate 7, a space 39 that extend the length of the groove. In the space 39 are disposed one or more pneumatic or hydraulic elements in the form of inflatable elastic hoses 41. In the left side wall 8, generally opposite hoses 41, one spring element for each elbow lever connecting rod 13 and 18, in the form of a pressure spring 43, is disposed. Each pressure spring 43 is placed in a blind bore 42, and acts on elbow lever joint at 16 and 17. The blind bores 42 are directed obliquely with respect to each of the elbow lever joint 16 and 17 in such a way that when the elbow lever joint is deflected, it approximately extends in the direction of the bore axis of the blind bores 42. The pressure springs 43 are seated against the bottom surfaces 44 of the blind bores 42 and push the elbow lever connecting rods 13 and 18 into a stretch, or straight position. The bellows or hoses 41 are disposed so that they counteract the pressure springs 43 and tend to move the elbow joint connecting rods 13 and 18 out of their stretch position.

A plurality of horizontal bores or cylinders 47 are disposed in an exterior surface 45 of the left side wall 8 of printing plate clamping device 3. A slidable piston 48 is disposed horizontally in each of the bores 47. These bores or cylinders 47, together with their pistons 48 each form a chamber in which is disposed an inflatable, elastic bellows 49. The pistons 48 are supported with free ends against the left wall 46 of cylinder groove 2. A plurality of blind bores 53, which face or open towards a right groove wall 52, are disposed in the center of the right side wall 9 and receive pressure springs 51. The pressure springs 51 are supported on the bottom of the corresponding blind bore 53 and act in a horizontal direction on the right groove side wall 52.

Figure 2:
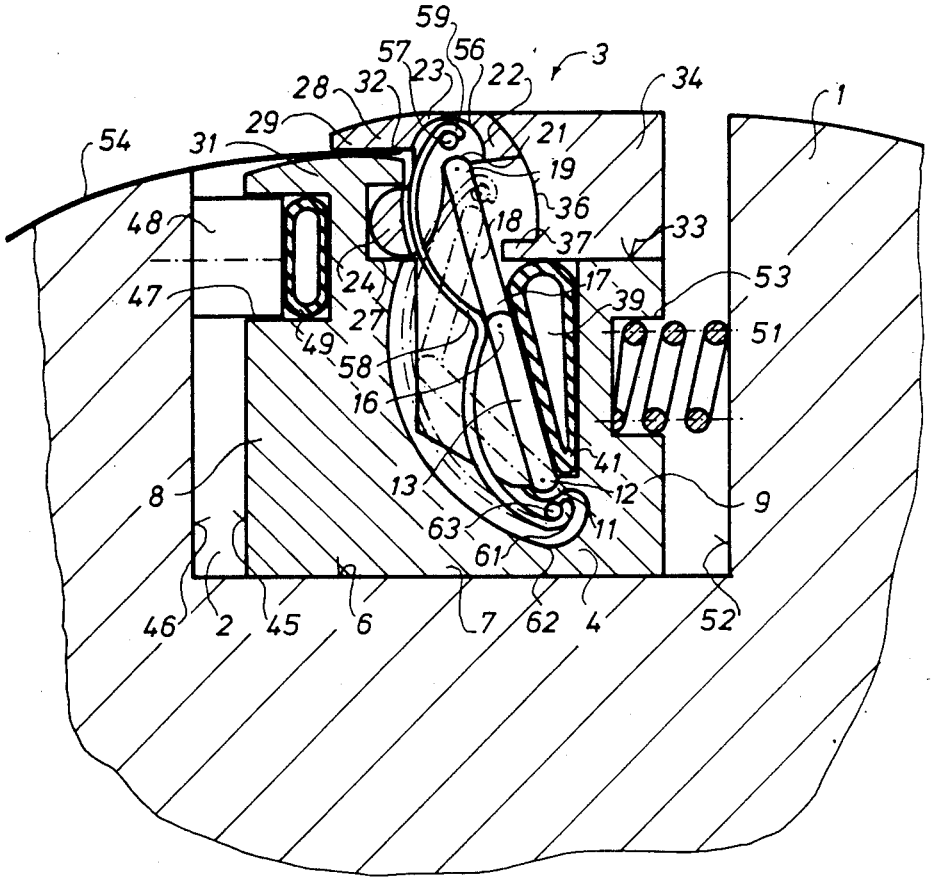
FIG. 2 is a cross-sectional view of a portion of a plate cylinder and showing a second preferred embodiment of the plate clamping assembly of the present invention.

A second preferred embodiment of the present invention is shown in FIG. 2. The force used to position the elbow lever connecting rods 13 and 18 into the stretch or straight position is provided by a plurality of spaced, parallel leaf springs 58, one such leaf spring 58 being assigned to each elbow lever connecting rod 13 and 18. With their upper ends 59, the leaf springs 58 enclose a journal 57 disposed in recesses 56 of the clamping bar 23. With their lower ends 61 the leaf springs 58 engage a journal 63 disposed in recesses 62 of the bottom plate 7 of the housing 4. The leaf springs 58 have an arched shape so that they always act with their center on the elbow lever joint 16, 17.

To operate the flexible printing plate clamping assembly in accordance with the present invention so as to be able to open the clamping flap 29, the hose 41 is charged with compressed air or the like via lines (not shown). The elastic hose 41 expands and bends the elbow lever joints 16 and 17 against the force of the pressure springs 43 or leaf springs 58. The lower connecting rods 13 pivot around the bearings 11. This pivots the clamping bar 23, through the upper connecting rods 18, about the thrust bearing 27 in the left side wall 8. After attaining a pivot angle $\alpha$ of approximately 30°, the end of the right lever arm 22 strikes against the shoulder 37. In this position the pressure springs 43 or leaf springs 58 are fully cocked and the elbow lever connecting rods 13 and 18 are angled. This position is shown by dashed lines. In this position, the left lever arm 28 of clamping bar 23 is raised off plate support 31.

To clamp a printing plate 54, the printing plate edge 32 is placed on the plate support 31. Then the previously pressurized hose 41 is exhausted. Now the pressure springs 43 or leaf springs 58 push the elbow levers 13 and 18 into the stretch or straight position and pivot the clamping bar 23 in a counter-clockwise direction into the clamping position. The clamping bar 23 is maintained by the elbow levers 13 and 18 in this clamped position due to the force of the pressure springs 43 or leaf springs 58.

To tension the printing plate 54, the bellows or hoses 49 are charged with compressed air or the like via lines (not shown). The elastic bellows 49 expand and push out their respective pistons 48. The pistons come into contact with the groove wall 46 and displace the housing 4 horizontally to the right against the force of the pressure springs 51. The printing plate 54, which has been clamped with its printing plate edge 32 between the clamping flap 29 and the plate support 31 and with its front edge between an identically designed non-slidable clamping device (not shown), is tensioned on the plate cylinder 1.

When the tension on the printing plate 34 is to be relaxed, the pressure is drained from the bellows 49. This allows the force of the compression springs 51 to move the printing plate clamping assembly 4 back to the left in cylinder groove 2. It will be understood that it would be possible to place the pressure springs 51 in the cylinder bores 47 and the pistons 48 and bellows 49 in the blind bores 53. In this way tensioning force would be applied constantly by springs 51 and would be released only when a pressurized fluid were supplied to the blind bores 53 or to bellows 49 placed in them.

The flexible printing plate clamping and tensioning assembly in accordance with the present invention will thus be seen as requiring no tools to operate and can be actuated by the press operator by use of suitable foot pedals or the like. It is an efficient, durable clamping assembly which operates effectively and allows quick press set-up to thereby keep nonproductive downtime to a minimum.

While preferred embodiments of a flexible printing plate clamping assembly in accordance with the present invention have been fully and completely set forth hereinabove, it will be apparent to one of skill in the art that a number of changes in, for example, the number of parallel elbow lever assemblies, the type of pneumatic or hydraulic pressure fluid used, the particular flexible printing plate clamped, and the like can be made without departing from the true spirit and scope of the subject invention which is, accordingly, to be limited only by the following claims.

What is claimed is:

1. A flexible printing plate clamping assembly for securing a flexible printing plate on the periphery of a plate cylinder in a rotary printing machine, said flexible printing plate clamping assembly comprising:

a printing plate clamping housing positioned in an axially extending groove formed in the periphery of the plate cylinder;

a clamping bar pivotably carried in said printing plate clamping housing and having a printing plate clamping flap;

a plurality of elbow lever assemblies carried in said housing and pivotable between folded and straight positions to effect movement of said clamping bar between printing plate clamping and unclamping positions; and spring means and opposing expandable means to pivot said elbow assemblies between said folded and straight positions.

2. The flexible printing plate clamping assembly of claim 1 wherein said expandable means are inflatable hoses.

3. The flexible printing plate clamping assembly of claim 1 wherein said spring means are pressure springs.

4. The flexible printing plate clamping assembly of claim 1 wherein said spring means are leaf springs.

5. The flexible printing plate clamping assembly of claim 1 wherein each of said elbow lever assemblies includes lower and upper connecting rods pivotably coupled to each other.

* * * * *